US009373291B2

(12) United States Patent
Chuang et al.

(10) Patent No.: US 9,373,291 B2
(45) **Date of Patent: *Jun. 21, 2016**

(54) METHOD AND DEVICE FOR MAPPING INPUT GRAYSCALES INTO OUTPUT LUMINANCE

(71) Applicant: NOVATEK Microelectronics Corp., Hsin-Chu (TW)

(72) Inventors: Yu-Hsing Chuang, Hsinchu (TW); Chih-Yuan Yang, Hsinchu County (TW); Yu-Pin Chang, Hsinchu County (TW); Feng-Ting Pai, Hsinchu (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/332,392

(22) Filed: Jul. 16, 2014

(65) Prior Publication Data

US 2016/0019850 A1 Jan. 21, 2016

(51) Int. Cl.
*G09G 3/36* (2006.01)

(52) U.S. Cl.
CPC ..... *G09G 3/3607* (2013.01); *G09G 3/3696* (2013.01); *G09G 2320/0233* (2013.01); *G09G 2320/0285* (2013.01); *G09G 2320/0646* (2013.01); *G09G 2340/16* (2013.01)

(58) Field of Classification Search
CPC ..... G09G 2320/0276; G09G 2320/0285; G09G 2360/141
See application file for complete search history.

(56) References Cited

U.S. PATENT DOCUMENTS

| | | | | |
|---|---|---|---|---|
| 6,115,092 | A * | 9/2000 | Greene et al. | 349/74 |
| 2007/0273686 | A1* | 11/2007 | Watanabe et al. | 345/419 |
| 2007/0285576 | A1* | 12/2007 | Moore et al. | 348/674 |
| 2010/0156956 | A1* | 6/2010 | Madden et al. | 345/690 |
| 2010/0195901 | A1* | 8/2010 | Andrus et al. | 382/162 |
| 2013/0135272 | A1* | 5/2013 | Park | 345/211 |

* cited by examiner

*Primary Examiner* — Ricardo L Osorio
(74) *Attorney, Agent, or Firm* — Winston Hsu; Scott Margo

(57) ABSTRACT

A method for mapping an input grayscale into an output luminance includes selecting a reference grayscale and a curvature according to an input grayscale; and generating an output luminance according to the reference grayscale, the curvature, and the input grayscale.

6 Claims, 10 Drawing Sheets

METHOD AND DEVICE FOR MAPPING INPUT GRAYSCALES INTO OUTPUT LUMINANCE

BACKGROUND OF THE INVENTION

1. Field of the Invention

The present invention relates to a method and device for mapping input grayscales into output luminance, and more particularly, to a method and device for mapping input grayscales into output luminance by computing a quadratic equation to precisely approximate any segments of ideal gamma curve.

2. Description of the Prior Art

In n-bit color depth display devices, each pixel of the display device has 2^n grayscales, each of which corresponds to a specific voltage level. In other words, various degrees of bright/dark visual performances are achieved by driving each pixel with 2^n distinct voltage levels.

Please refer to FIG. 1, which illustrates an ideal gamma curve for mapping input grayscales into distinct voltage levels, respectively. Take an 8-bit color depth display device for example, there are grayscales 1 to 254 corresponding to distinct 254 voltage levels for the ideal gamma curve, wherein grayscales 0 and 255 are respectively pure dark and pure white.

Traditionally, there are two methods for mapping the input grayscales into distinct voltage levels to perform bright/dark visual performances based on analog or digital operating environment.

For analog operating environment, a gamma voltage generator is composed of a plurality of series of resistors for generating distinct voltage levels. Under control of a logic device, the gamma voltage generator generates the specific gamma voltage corresponding to the input grayscale. However, resistances of the resistors are fixed once the gamma voltage generator is produced, which is customized only for one display model.

For digital operating environment, a pair of one grayscale and the corresponding voltage level forms a point or coordinate of the gamma curve shown in FIG. 1. Information of 254 points of the gamma curve for the 8-bit color depth display device is stored in a lookup table device of the display device, such that the display device is able to generate distinct voltage levels according to contents of the lookup table device. Contents of the lookup table device, e.g. one time programmable (OTP) memory, can be modified and customized for various display models, which is beneficial for mass production for various display models.

However, in practice, there is a limited number N of pinch points, instead of all the 254 points, stored in the lookup table device to save a hardware area of the lookup table device so as to save a production cost of the display device. The gamma voltages corresponding to the points other than the limited number N of pinch points are generated by computing a linear transformation equation for approximating the ideal gamma curve.

For example, any two of nearby pinch points determine a linear transformation equation, and a gamma voltage corresponding to an input grayscale between the nearby pinch points can be generated by performing a linear interpolation on the linear transformation equation. However, the ideal gamma curve shown in FIG. 1 is a nonlinear curve, and thus there is an approximation error when using the linear transformation equation to approximate the nonlinear gamma curve, which may cause unsmooth grayscale representation on the display device to be sensed by human vision.

In order to avoid unsmooth grayscale representation from the display device and improve a display quality of the display device, as many as pinch points are required, a greater hardware area of the lookup table device and a higher production cost of the display device are also required. In other words, there is a dilemma between the display quality and the production cost, i.e. smooth grayscale representation and the hardware area of the lookup table unit, based on a traditional mapping scheme for mapping the input grayscales into corresponding voltage levels, i.e. the linear interpolation on the linear transformation equation for approximating the nonlinear gamma curve.

Therefore, there is a need to improve the prior art.

SUMMARY OF THE INVENTION

It is therefore an objective of the present invention to provide a method and device for mapping input grayscales into corresponding voltage levels to improve the prior art.

The present invention discloses a method for mapping an input grayscale into an output luminance includes selecting a reference grayscale and a curvature according to an input grayscale; and generating an output luminance according to the reference grayscale, the curvature, and the input grayscale.

The present invention further discloses a device for mapping an input grayscale into an output luminance includes a lookup table unit, for storing a plurality of reference grayscales and a plurality of curvatures; and a logic unit, coupled to the lookup table unit, for selecting a reference grayscale and a curvature according to an input grayscale to generate an output luminance according to the reference grayscale, the curvature, and the input grayscale.

These and other objectives of the present invention will no doubt become obvious to those of ordinary skill in the art after reading the following detailed description of the preferred embodiment that is illustrated in the various figures and drawings.

DETAILED DESCRIPTION

Figure 2:
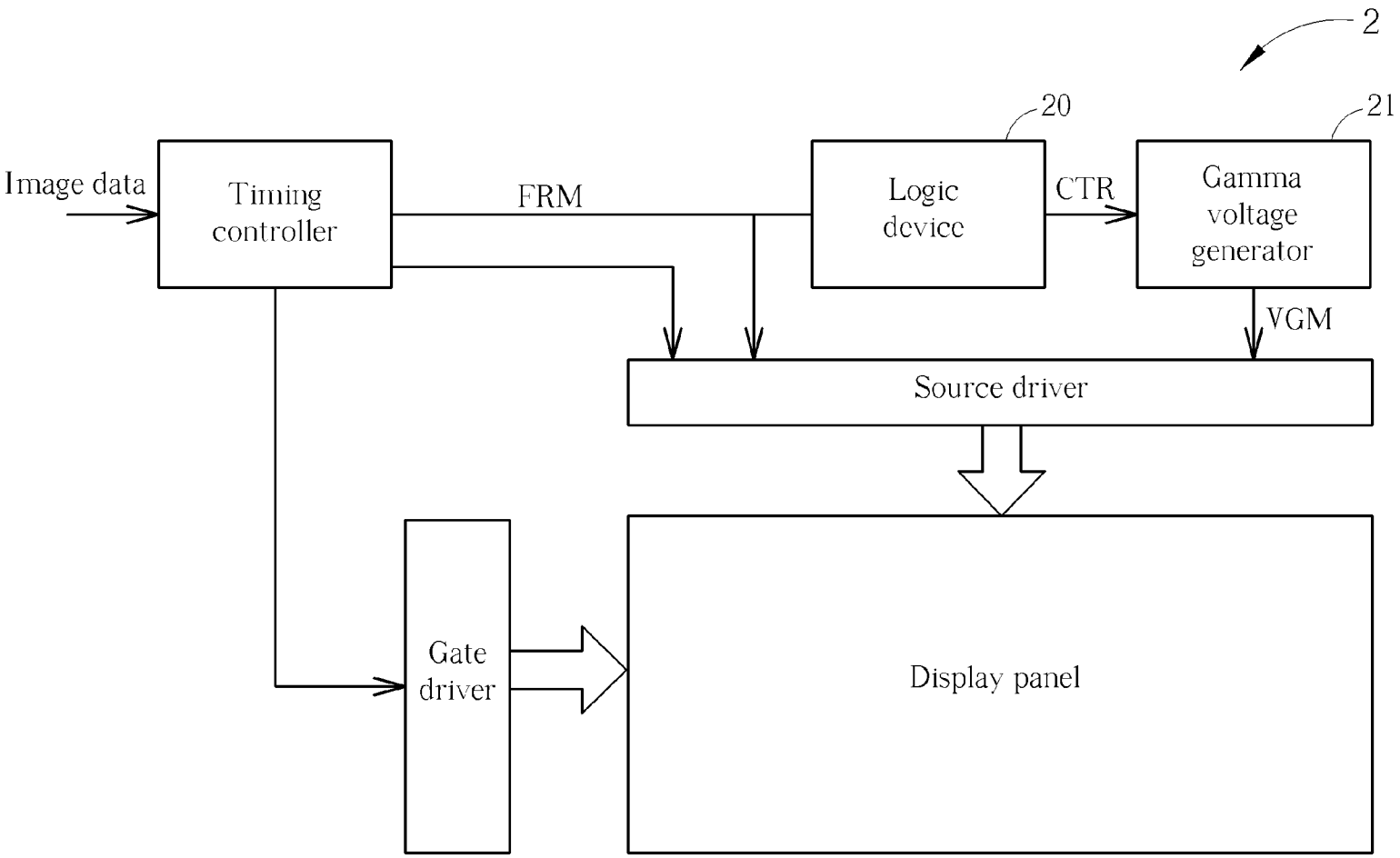
FIG. 2 is a schematic diagram of a liquid crystal display device 2.

Please refer to FIG. 2, which is a schematic diagram of a display device 2. The display device 2 includes a display panel, a source driver, a gate driver, a timing controller, a logic device 20 and a gamma voltage generator 21. The display panel, the source driver, the gate driver, and the timing controller of the display device 2 are fundamental components of the display device 2, of which the operating principles are well known in the art. The logic device 20 and the gamma voltage generator 21 cooperate to control bright/dark visual performances of the display device 2, and may be combined as a driving device or be integrated into the timing controller, which is not limited herein.

The logic device 20 generates a control signal CTR according to a frame signal FRM, wherein the frame signal FRM indicates an input grayscale X (which may be an 8-bit encoded digital signal) corresponding to a specific voltage level. The gamma voltage generator 21 generates a gamma voltage VGM to the source driver of the display device 2 according to the control signal CTR, wherein the control signal CTR indicates an output luminance Y (which may be a 10-bit encoded digital signal)corresponding to the grayscale X. In other words, the input grayscale X is mapped into the output luminance Y by the logic device 20 such that the gamma voltage generator 21 generates the gamma voltage VGM according to the output luminance Y indicated by the control signal CTR. As a result, the display panel maybe driven to display images of the frame signal FRM.

Figure 3:
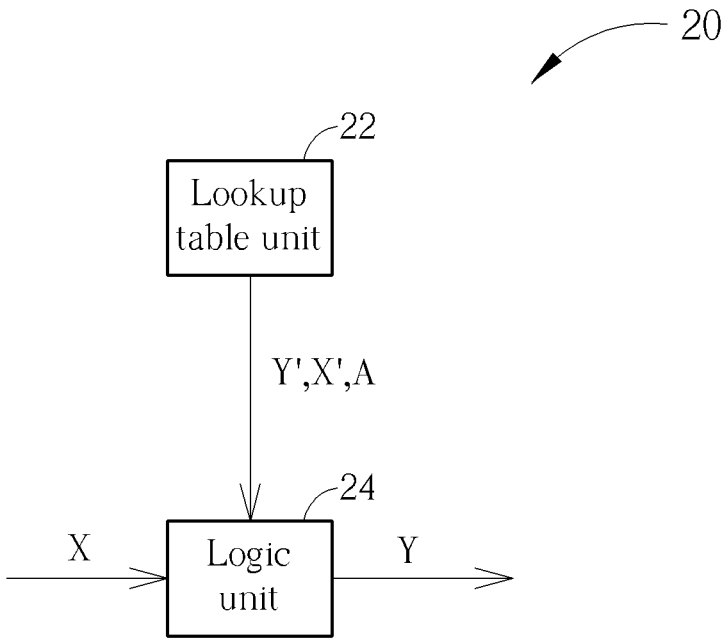
FIG. 3 is a schematic diagram of the logic device shown in FIG. 2 according to embodiments of the present invention.

Please refer to FIG. 3, which is a schematic diagram of the logic device 20 shown in FIG. 2 for mapping the input grayscale X into the corresponding output luminance Y according to a first embodiment of the present invention. The device 20 includes a lookup table unit 22 and a logic unit 24. The lookup table unit 22 is used for storing a plurality of reference grayscales corresponding to a plurality of curvatures, respectively.

The logic unit 24 is coupled to the lookup table unit 22 for selecting a reference grayscale X' and a curvature A from the plurality of reference grayscales and the plurality of curvatures according to the input grayscale X indicated by the frame signal FRM. The logic unit 24 then generates the output luminance Y according to the input grayscale X, the curvature A, and the reference grayscale X'.

Figure 1:
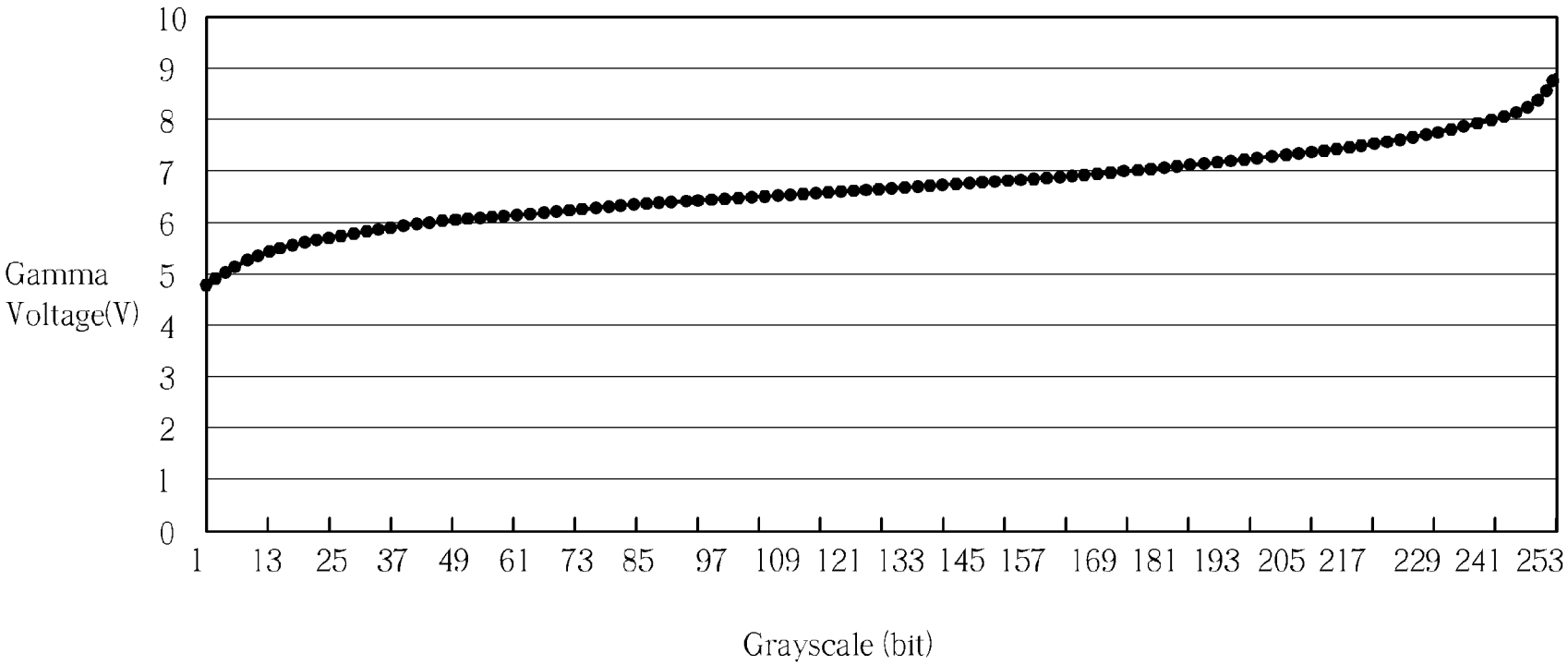
FIG. 1 PRIOR ART
FIG. 1 illustrates a gamma curve for mapping input grayscales into distinct voltage levels, respectively.
Figure 4:
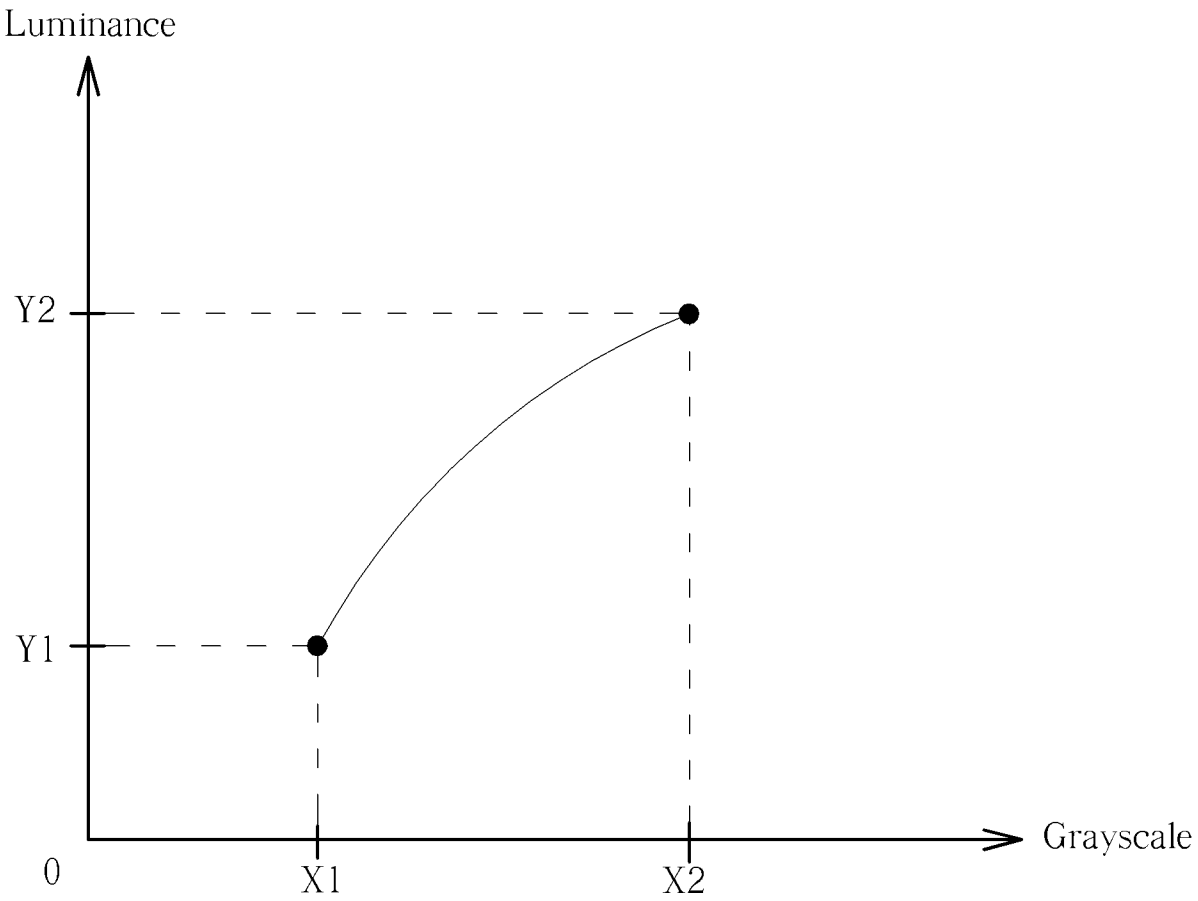
FIG. 4 illustrates a segment of the gamma curve shown in FIG. 1.

In detail, please refer to FIG. 4, which illustrates a segment of the gamma curve shown in FIG. 1, wherein the segment lies within an interval between grayscales X1 and X2 corresponding to luminance Y1 and Y2, respectively. A pair of one grayscale X1 or X2 and one luminance Y1 or Y2 forms a pinch point, i.e. a coordinate (X1, Y1) and (X2, Y2) of the gamma curve. Please note that the pinch points (X1, Y1) and (X2, Y2) may be representative of any nearby pinch points of the gamma curve shown in FIG. 1, which is not limited.

Figure 5:
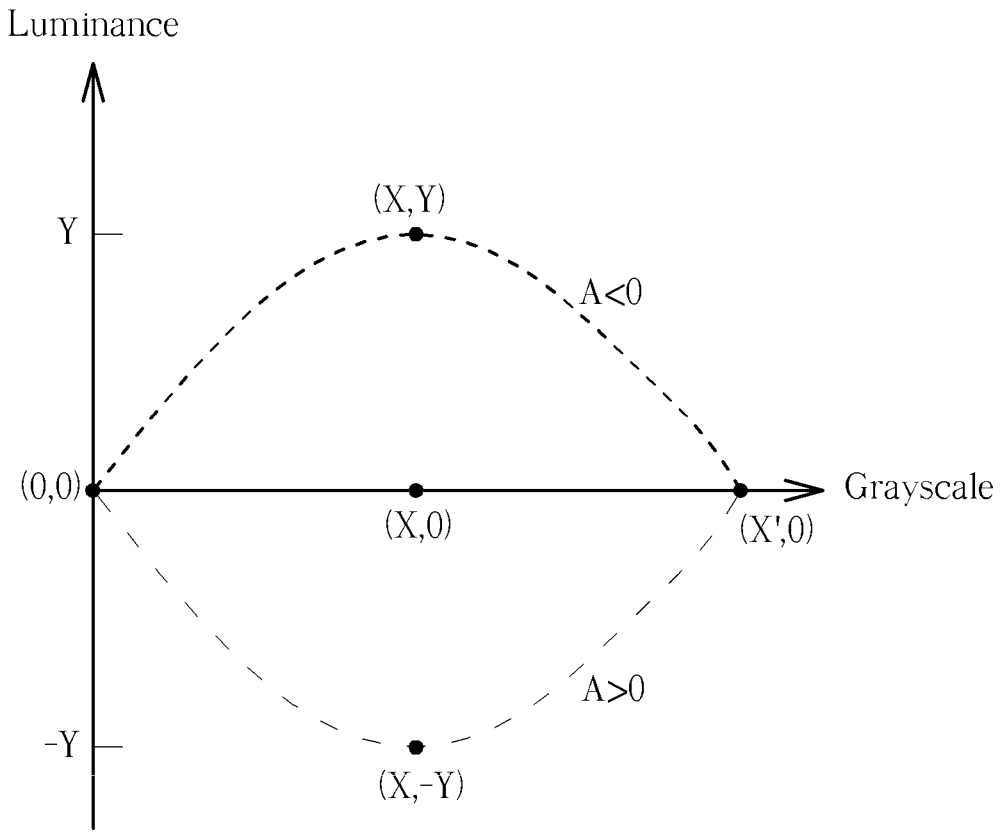
FIG. 5 illustrates a segment transformed from the segment shown in FIG. 4 according to a first embodiment of the present invention.

Please refer to FIG. 4 and FIG. 5 at the same time. FIG. 5 illustrates a segment transformed from the segment shown in FIG. 4 according to a first embodiment of the present invention.

In FIG. 4, the segment of the nonlinear gamma curve can be described with a quadratic equation or a second degree polynomials of:

$$Y=a*(X^2)+b*X+c \quad (1)$$

Wherein, a, b and c denote coefficients of the polynomials.

In FIG. 5, by performing coordinate transformation operations, e.g. displacement and rotation, the quadratic equation (1) can be transformed into another quadratic equation of:

$$Y=A*(X^2)-A*(X')*X \quad (2)$$

Wherein, A is a curvature of the quadratic equation (2).

Noticeably, the nearby pinch points (X1, Y1) and (X2 Y2) shown in FIG. 4 are respectively transformed into points (0,0) and (X',0) shown in FIG. 5, and the quadratic equation (2) can be regarded as a representative or approximation of the quadratic equation (1).

Figure 6:
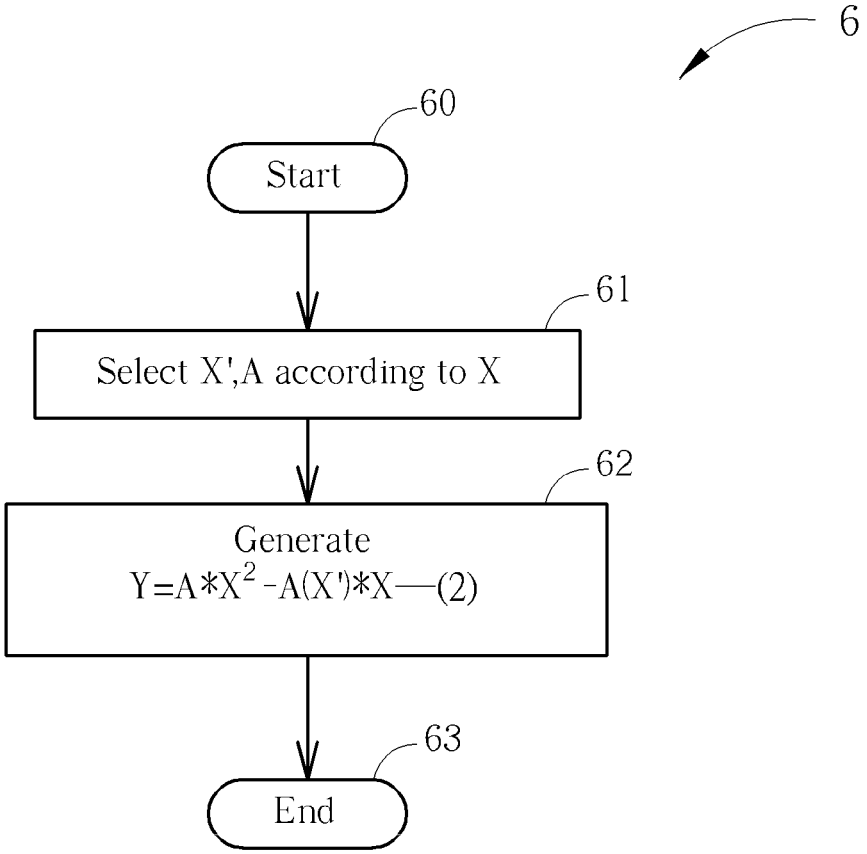
FIG. 6 is a schematic diagram of a process according to the first embodiment of the present invention.

Please refer to FIG. 6, which illustrates a flowchart of a process 6 for mapping the input grayscale X into the corresponding output luminance Y according to the first embodiment of the present invention. The process 6 describes a mapping scheme of the logic device 20 and includes the following steps:

Step 60: Start.

Step 61: Select the reference grayscale X' and the curvature A according to the input grayscale X.

Step 62: Generate the output luminance Y according to the reference grayscale X', the curvature A, and the input grayscale X.

Step 63: End.

In Step 61, the logic unit 24 selects the reference grayscale X' and the curvature A according to the input grayscale X from the lookup table unit 22, wherein the input grayscale X lies within the interval between grayscale X1 and X2 in an original domain shown in FIG. 4, and the input grayscale X lies within an interval between grayscale zero and X' in a transformed domain shown in FIG. 5.

In Step 62, the logic unit 24 generates the output luminance Y by computing the quadratic equation (2). Please note that the curvature A determines a shape of the segment shown in FIG. 5, which also determines values of the output luminance Y corresponding to various values of the curvature A.

During a developing phase of the logic device 20, a designer may determine numeric values of the plurality of pinch points and the corresponding values of the curvature A, such that the segment of the ideal gamma curve between any two nearby pinch points can be precisely approximated by computing the quadratic equation (2) under the limited number N of pinch points to save the hardware area of the lookup table device 22. In addition, since the segment of the ideal gamma curve between any two nearby pinch points can be precisely approximated, the unsmooth grayscale representation may be avoid from the display device 2 as well.

Figure 7:
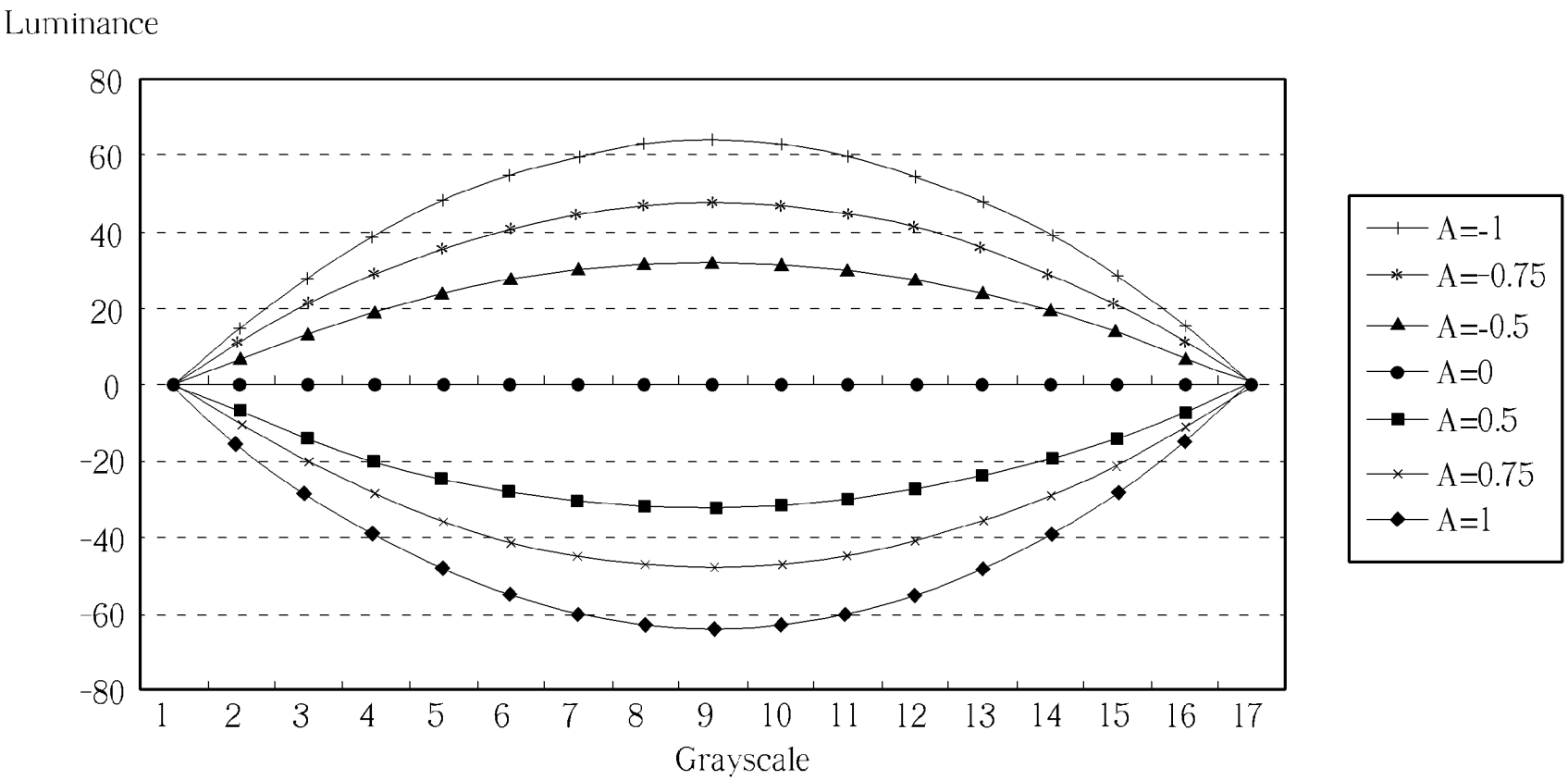
FIG. 7 illustrates the segment shown in FIG. 5 with various curvatures according to the first embodiment of the present invention.

For example, please refer to FIG. 7, which illustrates the segment shown in FIG. 5 with various values of the curvature A according to the first embodiment of the present invention. As can be seen from FIG. 7, the quadratic equation (2) with the curvature A having positive values, such as 0.5, 0.75 and 1, can be used for approximating upward-concaved segments of the ideal gamma curve; while the quadratic equation (2) with the curvature A having negative values, such as −0.5, −0.75 and −1, can be used for approximating downward-concaved segments of the ideal gamma curve.

Moreover, the shape of the quadratic equation (2) looks much curly if the value of the curvature A is greater, the shape of the quadratic equation (2) looks much straight if the value of the curvature A is smaller. Specifically, the segment with the curvature (A=1) is much curly than the segment with the curvature (A=0.75 or A=0.5) . As a result, by properly selecting the values of the curvature A, the quadratic equation (2) can be used for approximating any segments of the ideal gamma curve with any shapes.

In short, the logic device 20 of the present invention is capable of precisely approximating any segments of the ideal gamma curve by computing the quadratic equation (2) corresponding to various values of the curvature A, which reduces an approximation error when using a linear transformation equation to approximate the nonlinear ideal gamma curve and avoids unsmooth grayscale representation. Moreover, the segment of the ideal gamma curve between any two nearby pinch points can be precisely approximated by computing the quadratic equation (2) under the limited number N of pinch points to save the hardware area of the lookup table device 22 as well.

Please refer to FIG. 3 again for a second embodiment of the present invention. The lookup table unit 22 is further used for storing a plurality of reference luminance corresponding to the plurality of reference grayscales, respectively.

The logic unit 24 further selects a reference luminance Y', the reference grayscale X' and the curvature A from the plurality of reference luminance, the plurality of reference grayscales and the plurality of curvatures according to the input grayscale X indicated by the frame signal FRM. The logic unit 24 then generates the output luminance Y according to the reference luminance Y', the reference grayscale X', the input grayscale X and the curvature A.

Figure 8:
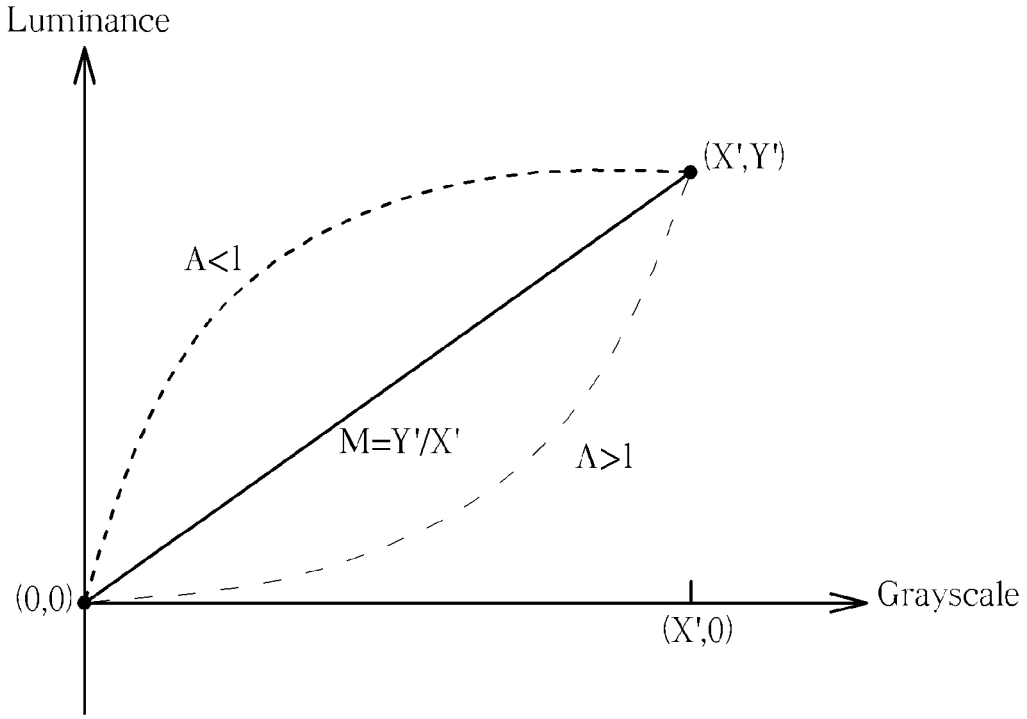
FIG. 8 illustrates a segment transformed from the segment shown in FIG. 4 according to a second embodiment of the present invention.

Please refer to FIG. 8, which illustrates another segment transformed from the segment shown in FIG. 4 according to the second embodiment of the present invention.

In FIG. 8, by performing coordinate transformation operations, e.g. displacement and rotation, the quadratic equation (1) can be transformed into another quadratic equation of:

$$Y=M*[X'^{(1-A)}]*[X'^{(A)}] \quad (3)$$

Wherein, M is a ratio of the reference luminance Y' and the reference grayscale X', which denotes a slope of the segment shown in FIG. 8.

Noticeably, the nearby pinch points (X1, Y1) and (X2, Y2) shown in FIG. 4 are respectively transformed into points (0,0) and (X',Y') shown in FIG. 8, and the quadratic equation (3) can be regarded as a representative or approximation of the quadratic equation (1).

Figure 9:
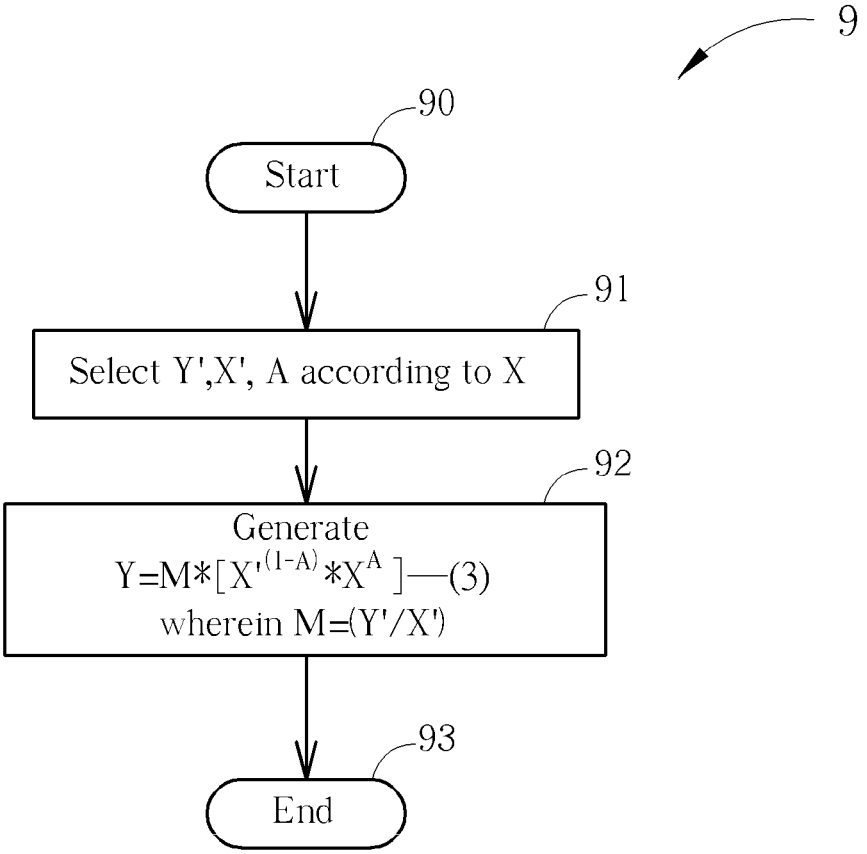
FIG. 9 is a schematic diagram of a process according to the second embodiment of the present invention.

Please refer to FIG. 9, which illustrates a flowchart of a process 9 for mapping the input grayscale X into the corresponding output luminance Y according to the first embodiment of the present invention. The process 9 describes another mapping scheme of the logic device 20 and includes the following steps:

Step 90: Start.

Step 91: Select the reference grayscale X', the reference luminance Y', and the curvature A according to the input grayscale X.

Step 92: Generate the output luminance Y according to the reference grayscale X', a slope M, the curvature A, and the input grayscale X, wherein the slope M is a ratio of the reference luminance Y' and the reference grayscale X'.

Step 93: End.

In Step 91, the logic unit 24 selects the reference grayscale X', the reference luminance Y', and the curvature A according to the input grayscale X from the lookup table unit 22, wherein the input grayscale X lies within the interval between grayscale X1 and X2 in the original domain shown in FIG. 4, and the input grayscale X lies within the interval between grayscale zero and X' in a transformed domain shown in FIG. 8.

In Step 92, the logic unit 24 generates the output luminance Y by computing the quadratic equation (3). Please note that the curvature A determines a shape of the segment shown in FIG. 8, which also determines values of the output luminance Y corresponding to various values of the curvature A.

During the developing phase of the logic device 20, the designer may determine numeric values of the plurality of pinch points and the corresponding values of the curvature A, such that the segment of the ideal gamma curve between any two nearby pinch points can be precisely approximated by computing the quadratic equation (3) under the limited number N of pinch points to save the hardware area of the lookup table device 22. In addition, since the segment of the ideal gamma curve between any two nearby pinch points can be precisely approximated, the unsmooth grayscale representation may be avoid from the display device 2 as well.

Figure 10:
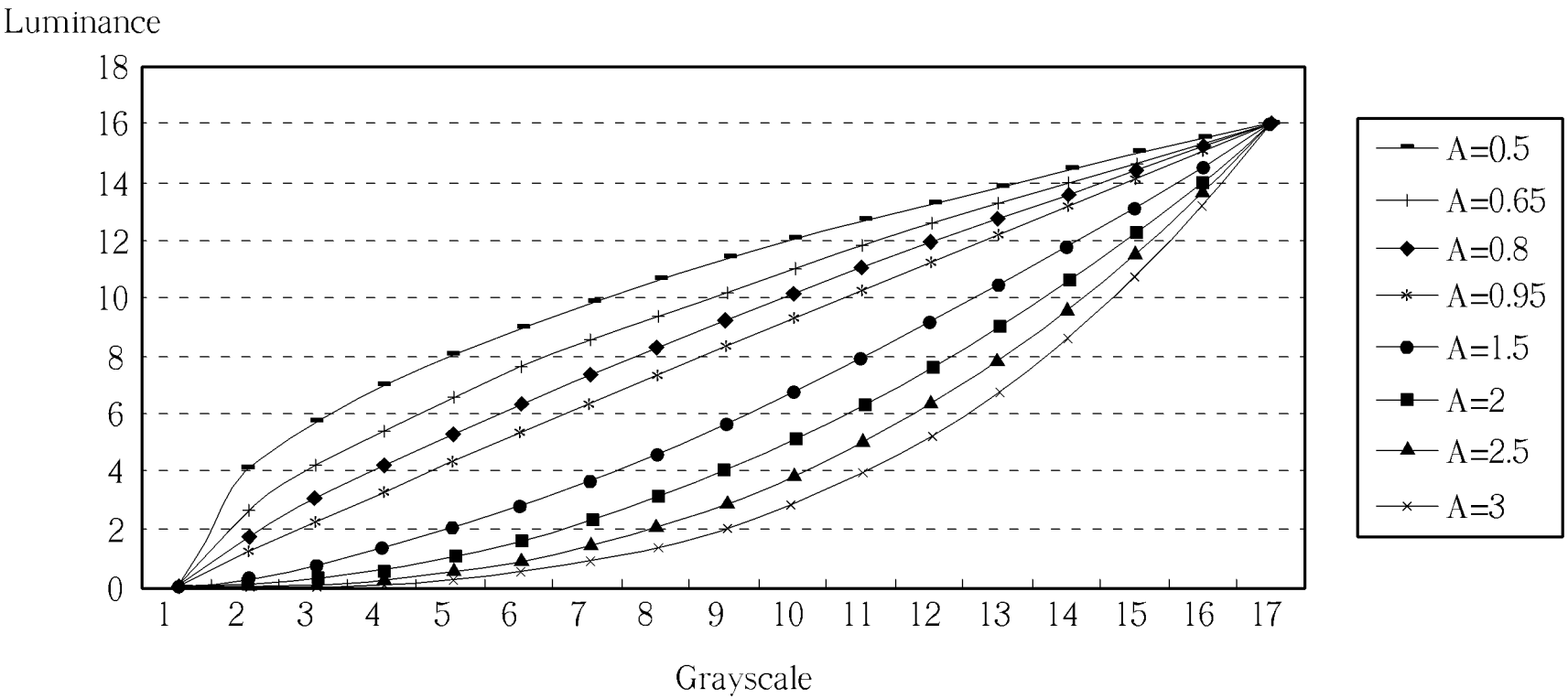
FIG. 10 illustrates the segment shown in FIG. 8 with various curvatures according to the second embodiment of the present invention.

For example, please refer to FIG. 10, which illustrates the segment shown in FIG. 8 with various values of the curvature A according to the second embodiment of the present invention. As can be seen from FIG. 10, the quadratic equation (3) with the curvature A having values smaller than one and greater than zero, such as 0.5, 0.65, 0.8 and 0.95, can be used for approximating downward-concaved segments of the ideal gamma curve; while the quadratic equation (3) with the curvature A having values greater than one, such as 1.5, 2, 2.5 and 3, can be used for approximating upward-concaved segments of the ideal gamma curve.

Moreover, the shape of the quadratic equation (3) looks much curly if the value of the curvature A is farther away from one; while the shape of the quadratic equation (3) looks much straight if the value of the curvature A is closer to one. Specifically, the segment with the curvature (A=0.5 or A=3) is much curly than the segment with the curvature (A=0.65, 0.8, 0.95, 1.5 or 2). As a result, by properly selecting the values of the curvature A, the quadratic equation (3) can be used for approximating any segments of the ideal gamma curve with any shapes.

In short, the logic device 20 of the present invention is capable of precisely approximating any segments of the ideal gamma curve by computing the quadratic equation (3) corresponding to various values of the curvature A, which reduces the approximation error when using the linear transformation equation to approximate the nonlinear ideal gamma curve and avoids unsmooth grayscale representation. Moreover, the segment of the ideal gamma curve between any two nearby pinch points can be precisely approximated by computing the quadratic equation (3) under the limited number N of pinch points to save the hardware area of the lookup table device 22 as well.

To sum up, the present invention provides two mapping schemes for mapping the input grayscale into the corresponding output luminance. One of the mapping schemes is using the quadratic equation (2) or (3) corresponding to various values of the curvature to precisely approximate any segments of the ideal gamma curve, which reduces the approximation error when using the linear transformation equation to approximate the nonlinear ideal gamma curve and avoids unsmooth grayscale representation. Moreover, the segment of the ideal gamma curve between any two nearby pinch points can be precisely approximated by computing the quadratic equation (2) or (3) under the limited number of pinch points to save the hardware area of the lookup table device as well.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for mapping an input grayscale into an output luminance comprising:

selecting a reference grayscale and a curvature according to an input grayscale; and generating an output luminance according to the reference grayscale, the curvature, and the input grayscale, wherein the output luminance is generated by computing an equation of: $Y=A*(X^2)-A*(X')*X$, wherein Y denotes the output luminance, A denotes the curvature, X denotes the input grayscale, and X' denotes the reference grayscale.

2. The method of claim 1, wherein generating the output luminance according to the reference grayscale, the curvature, and the input grayscale comprises:

generating the output luminance according to the reference grayscale, the curvature, the input grayscale, and a slope, wherein the reference grayscale is corresponding to a reference luminance, and the slope is a ratio of the reference luminance and the reference grayscale.

3. The method of claim 2, wherein the output luminance is generated by computing an equation of:

$Y=M*[X'\hat{}(1-A)]*[X\hat{}(A)]$, wherein M denotes the slope.

4. A device for mapping an input grayscale into an output luminance comprising:

a lookup table unit, for storing a plurality of reference grayscales and a plurality of curvatures; and a logic unit, coupled to the lookup table unit, for selecting a reference grayscale and a curvature according to an input grayscale to generate an output luminance according to the reference grayscale, the curvature, and the input grayscale, wherein the output luminance is generated by computing an equation of: $Y=A*(X^2)-A*(X')*X$, wherein Y denotes the output luminance, A denotes the curvature, X denotes the input grayscale, and X' denotes the reference grayscale.

5. The device of claim 4, wherein the logic device further generates the output luminance according to the reference grayscale, the curvature, the input grayscale, and a slope, wherein the reference grayscale is corresponding to a reference luminance, and the slope is a ratio of the reference luminance and the reference grayscale.

6. The device of claim 5, wherein the output luminance is generated by computing an equation of:

$Y=M*[X'\hat{}(1-A)]*[X\hat{}(A)]$, wherein M denotes the slope.

* * * * *